US008256514B2

(12) United States Patent
Winzer

(10) Patent No.: US 8,256,514 B2
(45) Date of Patent: Sep. 4, 2012

(54) DOWN-HOLE ACTUATION DEVICE STORAGE APPARATUS AND METHOD FOR LAUNCHING

(75) Inventor: Colin David Winzer, Sylvan Lake (CA)

(73) Assignee: Stream-Flo Industries Ltd., Edmonton (CA)

( * ) Notice: Subject to any disclaimer, the term of this patent is extended or adjusted under 35 U.S.C. 154(b) by 0 days.

(21) Appl. No.: 12/508,455

(22) Filed: Jul. 23, 2009

(65) Prior Publication Data

US 2010/0294511 A1 Nov. 25, 2010

Related U.S. Application Data

(60) Provisional application No. 61/179,878, filed on May 20, 2009.

(51) Int. Cl.
*E21B 33/13* (2006.01)

(52) U.S. Cl. ..... 166/291; 15/104.062; 166/75.15

(58) Field of Classification Search ..... 166/291, 166/70, 75.15, 379, 285; 15/104.062
See application file for complete search history.

(56) References Cited

U.S. PATENT DOCUMENTS

| | | | | | |
|---|---|---|---|---|---|
| 3,322,197 | A * | 5/1967 | Baker et al. | ..... | 166/75.15 |
| 4,671,353 | A * | 6/1987 | Daming | ..... | 166/70 |
| 4,782,894 | A * | 11/1988 | LaFleur | ..... | 166/70 |
| 5,833,002 | A * | 11/1998 | Holcombe | ..... | 166/291 |
| 5,960,881 | A * | 10/1999 | Allamon et al. | ..... | 166/291 |
| 7,571,773 | B1 * | 8/2009 | West et al. | ..... | 166/373 |
| 2008/0223587 | A1 | 9/2008 | Cherewyk | | |
| 2009/0194291 | A1 * | 8/2009 | Fesi et al. | ..... | 166/369 |
| 2010/0288496 | A1 * | 11/2010 | Cherewyk | ..... | 166/284 |

* cited by examiner

*Primary Examiner* — David Andrews
*Assistant Examiner* — Kipp Wallace
(74) *Attorney, Agent, or Firm* — Bennett Jones LLP

(57) ABSTRACT

An apparatus for holding and launching down-hole actuation devices that has a body, a bottom end, a top end and a long bore between the ends. Moveable and protruding into the long bore are retainers upon which down-hole actuation devices may rest. Retainers are moved by a lockable hydraulic drive system. Additionally, a method for loading the apparatus with down-hole actuation devices and for launching said devices into a well bore is provided.

10 Claims, 3 Drawing Sheets

DOWN-HOLE ACTUATION DEVICE STORAGE APPARATUS AND METHOD FOR LAUNCHING

FIELD

The present invention relates to an apparatus that houses, and controls the release of, down-hole actuating devices for oil and gas wells.

BACKGROUND

Down-hole actuating devices serve various purposes. Down-hole actuating devices such as balls, darts, etc. may be released into a wellhead to actuate various down-hole systems.

The current industry practice and state of the art can require the connection of additional pumping lines, additional hydraulic fracturing fluids, and extra pumping sources to launch down-hole actuating devices into a well bore.

Alternatives to the current industry practice and state of the art for launching down-hole actuating devices are of interest as they may provide apparatuses and methods for launching down-hole actuating devices without the additional requirements of the current practice.

SUMMARY

In accordance with a broad aspect of the present invention there is provided an apparatus for holding and launching down-hole actuation devices into a well including a body with a bottom end, a top end and a long bore that extends from the bottom end to the top end, the bottom end formed for connection above a well head to place the long bore in fluid communication with the well head. Further, a first retainer and a second retainer each of the first and second retainer being extendable into a blocking position in the long bore, and retractable from the blocking position in the long bore, the first and second retainers being spaced apart along the long bore defining there between a first down-hole actuation device retaining space and a second down-hole actuation device retaining space between the second retainer and to the top end, the first retainer being moveable into and out its blocking position independently of the second retainer to hold or allow release of a down-hole actuation device from the long bore.

In accordance with another broad aspect of the present invention, there is provided a method for launching down-hole actuation devices including (a) providing an apparatus for holding down-hole actuation devices including a body with a bottom end, a top end and a long bore that extends from the bottom end to the top end, bottom end formed for connection above a well head to place the long bore in fluid communication with the well head and a first retainer and a second retainer each of the first and second retainer being extendable into a blocking position in the long bore, and retractable from the blocking position in the long bore, the first and second retainers being spaced apart along the long bore defining there between a first down-hole actuation device retaining space and a second down-hole actuation device retaining space between the second retainer and to the top end, the first retainer being moveable into a blocking position and a release position independently of the second retainer to hold or allow release of a down-hole actuation device from the long bore; with the first retainer in its blocking position, loading a first down-hole actuation device into the long bore to rest upon the first retainer and within the first down-hole actuation device retaining space; moving the second retainer into a blocking position and a second down-hole actuation device is loaded into the long bore to rest upon the second retainer within the second down-hole actuation device retaining space; connecting the apparatus at the bottom end to the well head; and moving the first retainer into a release position allowing the first down-hole actuation device to launch into the well head.

It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the spirit and scope of the present invention. Accordingly the drawings and detailed description are to be regarded as illustrative in nature and not as restrictive.

DESCRIPTION OF DRAWINGS

Referring to the drawings, several aspects of the present invention are illustrated by way of example, and not by way of limitation, in detail in the figures, wherein.

DETAILED DESCRIPTION

The detailed description set forth below in connection with the appended drawings is intended as a description of the present invention and is not intended to represent the only embodiments contemplated by the inventor. The detailed description includes specific details for the purposes of providing a comprehensive understanding of the present invention. However, it will be apparent to those skilled in the art that the present invention may be practiced without these specific details.

Down-hole actuating devices such as balls, darts, etc. may be released into a wellhead to actuate various down-hole systems.

Figure 1:
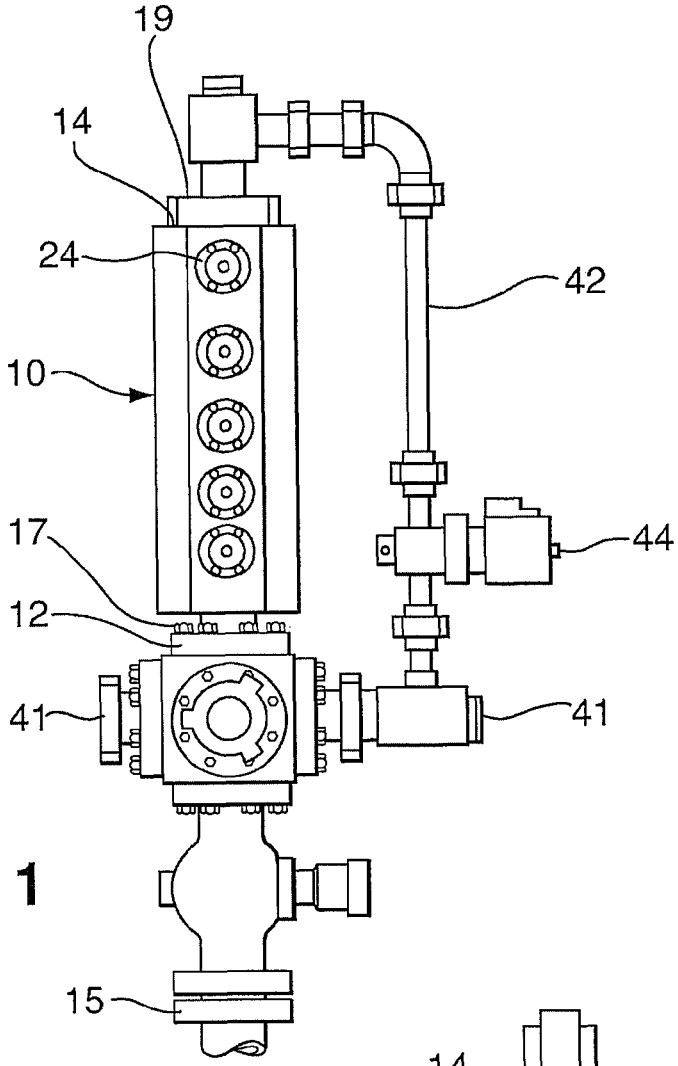
FIG. 1 is a side elevation view of the apparatus.
Figure 2:
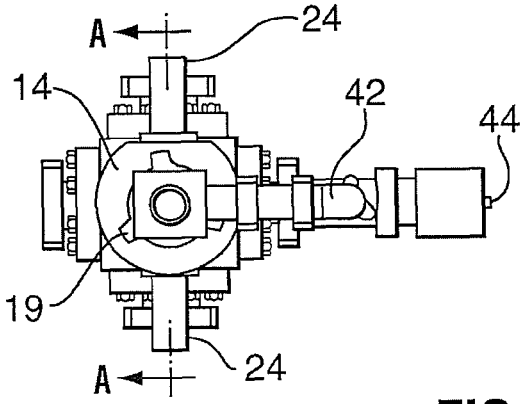
FIG. 2 is a sectional top-plan view of the apparatus.
Figure 3:
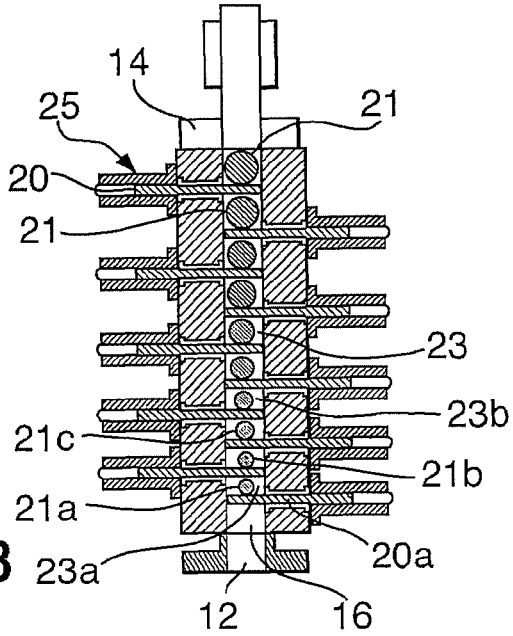
FIG. 3 is a sectional view of the apparatus along line 'A-A' of FIG. 2.

Referring to FIGS. 1 to 5 a down-hole actuating device storage and launching apparatus is shown. In FIG. 1 the body of the apparatus 10 is shown with a bottom end 12 and a top end 14. As shown in FIG. 3, there is a long bore 16 that runs through the body 10. Long bore 16 provides that down-hole actuation devices 21 and possibly fluids may travel between the bottom end 12 and the top end 14. The bottom end 12 may be formed such that it can be connected to various well head apparatus and to place the long bore 16 in communication with the well bore. For example, bottom end 12 may be formed with a flanged connection that can be secured by bolts 17 on a wellhead 15. The top end 14 can be formed to releasably retain a cap 19 to provide access to the bore but also to seal the bore from fluid communication outside the apparatus.

There are a series of ports 18 spaced along the sides of the body of the apparatus 10, which permit communication from the long bore 16 to outside the body of the apparatus 10.

For the purposes of holding down-hole actuating devices 21 within the long bore 16, a retainer 20 is inserted through each port 18. Each retainer is of adequate dimensions to be extended into the long bore 16 to block passage therethrough of a down-hole actuation device 21, but each retainer may be retracted to open the long bore 16 to passage of the down-hole actuation device 21. As such, retainers 20 moveable within ports 18 can each move to protrude into long bore 16 or be retracted from the long bore 16 to control the movement of down-hole actuation devices 21 through the long bore 16. If an individual retainer 20 is fully extended through a port 18 into the long bore 16, this is referred herein to as a blocking position. Each of retainers 20 of FIG. 3 are shown in the blocking position. When said retainer 20 is in a blocking position, it need only extend into the long bore 12 a distance to block passage of a down-hole actuation device 21. It need not completely extend across the diameter of the long bore 12, as shown, or obstruct the passage of fluids through the long bore 16, but extend only to such an extent that no down-hole actuation device 21 may pass.

As such, when a retainer 20*a* is in a blocking position with all others retainers 20 between it and end 14 are retracted, a down-hole actuation device 21*a* can be loaded through the top end 14 to the long bore 16, and will drop into a position onto retainer 20*a* to accommodate retainer 23*a* above retainer 20*a*.

The retainer 20 may also be retracted from the long bore 16 through the port 18. The retracted position of retainer 20 is referred to as a release position, and is that position when retainer 20 is retracted to such a point that it would not the prevent largest down-hole actuating device 21 that long bore 16 can house from traveling from the top end 14 towards, and out of, the bottom end 12.

By way of example, the retainer 20 may be in the form of a rod, a bar, a plate or another structure that can be extended into a blocking position within the long bore 16 and moved into a release position. The retainers can be made of steel, iron, composite alloys, polymers, composite polymers, wood or any materials that is of adequate strength to support the weight of a down-hole actuation device 21 and which is durable against the rigors of well site operation. Further, the retainers must also be able to withstand fluctuations in long bore pressure that may arise from time to time when the long bore 16 communicates with the well bore.

There may be various materials 27 acting between the retainer and the port wall within each port 18 which act as a stuffing box, sealing gland or sealing materials to prevent the communication of pressure from the long bore 16 through the port 18. Ports 18, and hence retainers 20, may be spaced along the apparatus in various ways to leave space in long bore 16 therebetween such that at least one down-hole actuation device 21 maybe accommodated in the long bore 16 between each retainer 20.

Retainers 20 may be evenly spaced apart. Alternatively, as in FIG. 3, the distance between each port 18, and hence each retainer 20, can vary. For example, spaces 23 between retainers 20 can increase from a shorter distance proximal to bottom end 12 to a larger distance distal bottom end 12 so that down-hole actuation devices 21 of different sizes, graduated larger sizes from bottom to top, can be accommodated by the apparatus. For example in normal operation of some down-hole actuation tools actuated by multiple down-hole actuating devices 21, larger down-hole actuating devices 21 may be launched after smaller down-hole actuation devices 21. For example, a plurality of actuating devices 21 may be launched into the well, each successive device launched being larger than the preceding one. As such, it may be useful to provide an apparatus that can hold large and small diameter down-hole actuation devices 21. For example, an apparatus may be useful that can hold a plurality of down-hole actuating devices 21, each with a different outer diameter and to hold the down-hole actuation devices 21 with the smallest diameter down-hole actuation device 21 capable of being released from bottom end 12 first before release of any of the larger diameter down-hole actuation devices 21. In such an embodiment it may be useful that larger down-hole actuation devices 21*c* are stored more distal from the bottom end 12 than smaller down-hole actuations devices 21*a*. For example the down-hole actuating device 21*a* that rests on retainer 20*a* that is most proximal to the bottom end 12 could be intended, as by sizing of the retainer 20*a*/or space 23*a* to retain the smallest diameter device to be employed, while each next adjacent retainer 20 in series may be sized and/or spaced to allow a progressively larger down-hole actuation device 21 to be retained thereon.

Each retainer 20 may be driven between its blocking position and its release position. The present application may include a driver for moving each retainer 20 between these positions. In the illustrated embodiment of FIG. 5 the driver includes a hydraulic cylinder 24 with a piston 22. Retainer 20 may act as a rod of the cylinder driven by piston 22 in response to fluid pressure differentials about the piston. Each retainer 20 is connected to be moved by its piston 22. Each piston 22 provides control over the position of one individual retainer 20, independently of the other retainers 20. As such, driving one piston 22, moves only one retainer 20.

Each piston 22 can be housed inside a housing 25 installed in or on the outer most wall of body 10 adjacent each port 18. Housing 25 may fully enclose the hydraulic chamber hydraulic cylinder 24 or the hydraulic chamber may be formed in part by a portion of the body 10. The stuffing box or sealing gland materials 27 within each port 18 may act between the port wall and retainer 20 to isolate the pressure of the long bore 16 from the pressure inside the hydraulic cylinder 24. Alternatively, or in addition, other seals may be employed to fluidly seal the hydraulic cylinder from long bore 16.

Fluctuations of well bore pressure can communicate with the long bore 16. As such, a locking mechanism may be useful that will hold any or all retainers 20 in a given position against the pressures urging the retainers 20 to move. There can be manually operated locks, pneumatic locks, hydraulic locks, electronic or magnetic locks to ensure that the position of the retainer 20 is not influenced by fluctuations of pressure within the long bore 16. In one example, the locking mechanism on the hydraulic cylinder 24 can maintain the position of the retainer 20 even when up to 10,000 pounds per square inch of driving pressure is applied from within the long bore 16.

One embodiment of a locking mechanism may be connected to operate in response to the hydraulic pressure driving the cylinder. For example the hydraulic driver can be double acting, wherein fluid may be introduced on either side of the piston 22 to drive retainer 20 between the blocking position and the retracted position. There can be two ports that permit the communication of hydraulic fluid into and out of the hydraulic cylinder 24. One port, referred to as proximal port 26, is proximal to the body 10. Pressure introduced through proximal port 26 and line 36, connected thereto, acts to retract retainer 20. The second port, referred to as the distal port 28, is distal to the body 10 and opens on the side of the piston 22 such that fluid introduced therein from line 38 acts to drive the piston 22 toward long bore 16 and hence move the retainer 20 into a blocking position. Within the hydraulic cylinder 24 the piston 22 has a limited positional range between the proximal port 26 and distal port 28, in that the piston 22 cannot move to block or pass the proximal port 26 and cannot move to block or pass distal port 28. A locking mechanism may be selected to only allow evacuation of fluid through port 28 if pressure is being applied through port 26. As such, piston 22 and retainer 20 can only retract if fluid is being driven into hydraulic cylinder 24 to drive the piston and the retainer cannot move solely by pressure within the long bore 16 acting there against. Controlling the evacuation of fluid from distal port 28 is a valve 30. When valve 30 is closed, no fluid may exit through distal port 28. Valve 30 is actuated by sensor 32 to open. Sensor 32 is responsive to hydraulic pressure in line 36 that is communicated to sensor 32 via line 37. When hydraulic pressure is increased in line 36 from source 34*a*, as when retainer 20 is driven to retract, such increase in hydraulic pressure is sensed by sensor 32 which allows valve 30 to open to permit the evacuation of fluid through port 28 to allow the piston 22 to move. Sensor 32 can be selected to only permit opening of valve 30 when a particular pressure is sensed in lines 36 and 37. For example, when pressure of the hydraulic fluid exceeds a preset level, for example 3,000 p.s.i., sensor 32 opens valve 30 and hydraulic fluid can exit the hydraulic cylinder via distal port 28. The movement of hydraulic fluid into hydraulic cylinder 24 through proximal port 26 and out of hydraulic cylinder 24 through distal port 28 allows piston 22 to move from a position proximal body 10 to a more distal position. In turn this causes retraction of retainer 20. Hydraulic fluid leaves hydraulic cylinder 24 through distal port 28, opened valve 30 and line 38 which returns the hydraulic pressure or fluid back to source 34*a*.

As one can appreciate, if hydraulic fluid is communicated from source 34*a* through line 38, that hydraulic fluid passes through valve 30, through distal port 28 and into hydraulic cylinder 24 to drive piston 22 toward long bore 16. Hydraulic pressure can passively leave hydraulic cylinder 24 via proximal port 26 permitting piston 22 to displace towards body 10 and drive retainer 20 into long bore 16.

Figure 4:
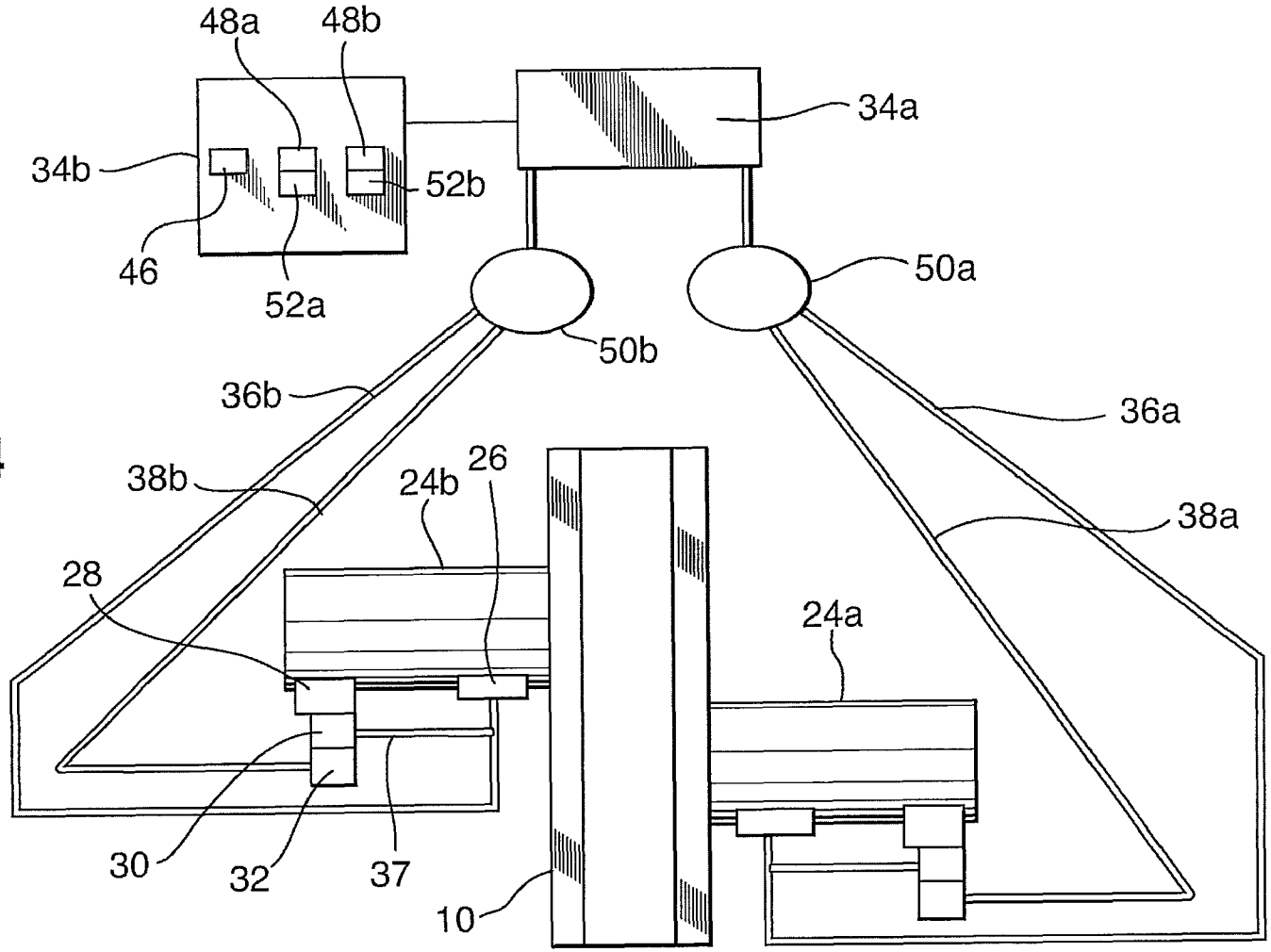
FIG. 4 is a schematic illustration of the apparatus, control system, loading spools and source.
Figure 5:
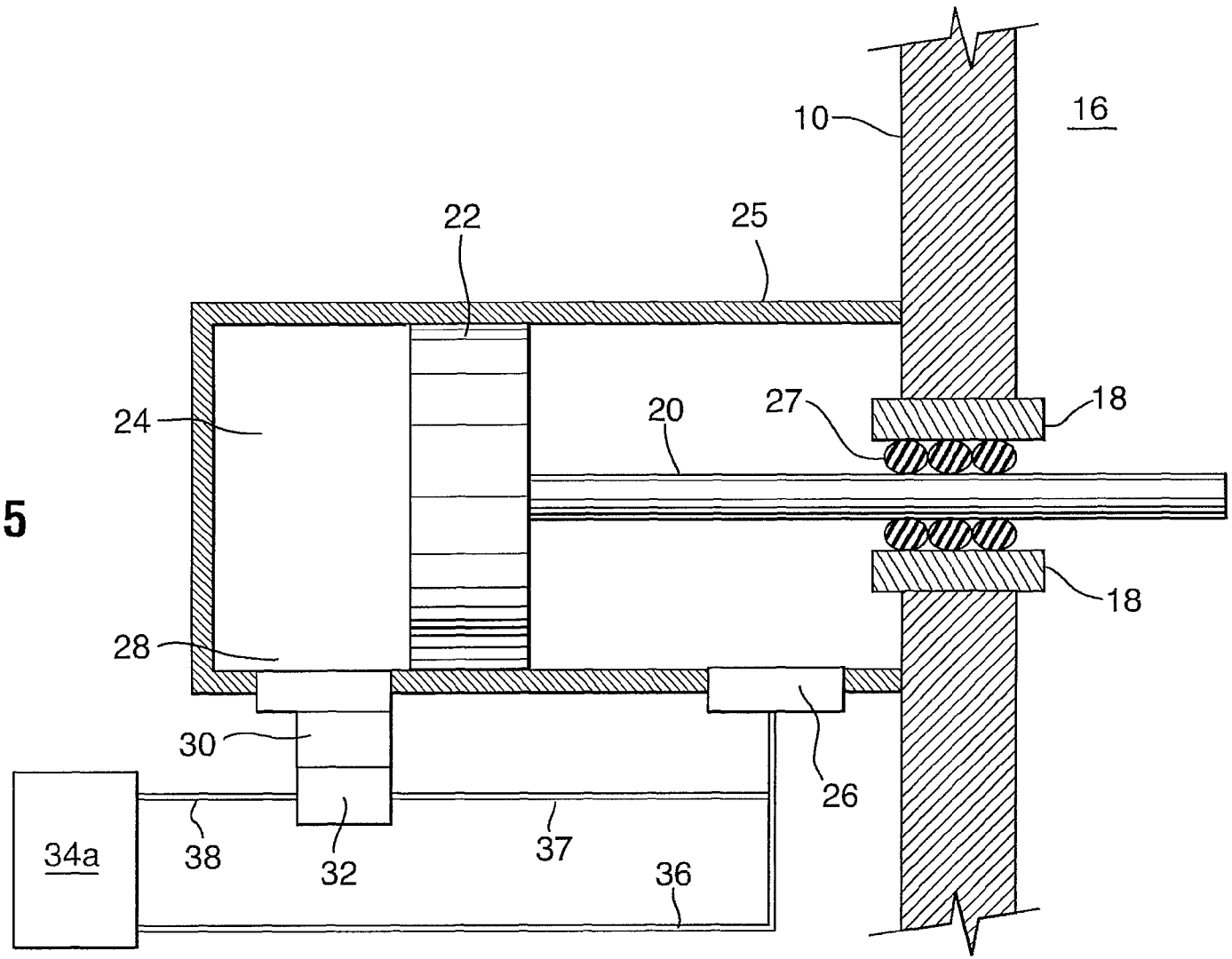
FIG. 5 is a schematic illustration of a one-way hydraulic lock.

The position of each retainer can be controlled by a control panel 34*b*, as shown in FIG. 4. The position of each retainer 20 can be actuated between a release and a blocking position, and any position in between, by manipulation of buttons, levers, controls, touch screen locations, computer interface etc. of control panel 34*b*. There may also be indicators as to the position of each piston 22 or retainer 20, for example a visual display that depicts position within the hydraulic cylinder relative to either the proximal port 26 and or the distal port 28. The position of each piston 22 and its associated retainer 20 may be locked in a blocking position, a release position or a position between these two positions. There may be various embodiments of control panel 34*b*, some would require a specific sequence or series of sequential actuation steps to ensure that the correct piston 22 is actuated at any given time. For example, in one embodiment the operator might first select a controller for piston 22 they desire to actuate. Secondly, the operator might activate a selector to drive retainer 20 into a blocking position or alternatively into a retracted position. As such, retainers 24 can be controlled at panel 34*b* for loading down-hole actuation devices 21 into the apparatus and also for the sequential launching of down-hole actuation devices 21 into the well-head.

Of course in various embodiments, the position of retainers 20 can be controlled manually by way of an operator driven mechanisms, hydraulically, pneumatically, robotically or any other means by which the position of retainer 20 can be actuated between a blocking position and a release position. Further, from time to time there may be communication of fluctuating well-bore pressure upon retainers 20 therefore in all embodiments it may be useful to permit locking of retainer 20 in the various desired positions.

Down-hole actuation device 21 can be loaded into long bore 16 and individual down-hole actuation device 21 may rest upon an individual retainer 20 in preparation to be launched into a well-head to actuate various down-hole tools. In operation of the example apparatus and system illustrated herein, to load down-hole actuation devices 21 control panel 34*b* can be used to control the driving of hydraulic pistons 22 to move all or selected retainers 20 into their release positions. Using control panel 34*b*, while at least selected retainers are retracted from long bore 16, in their release positions, hydraulic cylinder 24 that actuates the position of a retainer of interest, for example retainer 20*a* that is most proximal to bottom end 12 is driven to extend retainer 20*a* into a blocking position in long bore 16. The retainer of interest may be the retainer closest to bottom end 12 or another retainer 20 it being noted however, that since down-hole actuation devices 21 are loaded from top end 14 by gravity, it will be appreciated that the lowest retainer of interest (i.e. the retainer of interest that is closest to the bottom end of long bore 15) must be loaded first and thereafter the next lowest retainer 20 is driven into a blocking position and loaded with the next down-hole actuation device 21 etc. sequentially working up long bore 16 from the lowest to the highest retainers of interest. Likewise, if only selected retainers 20, rather than all retainers 20 are retracted for loading, it will be appreciated that all retainers between the loading point and the retainer of interest must be retracted to open a path for passage of the down-hole actuation device 21.

For example, a down-hole actuating device 21*a* can be loaded from top end 14 inside long bore 16 so that it rests upon retainer 20*a* that is in a blocking position and accommodates a down-hole actuation retaining space 23*a*. Thereafter, retainer 20*b*, above the first driven retainer 20*a*, which is of interest and next most proximal to bottom end 12 can be extended into a blocking position by driving its cylinder 24*b* and another down-hole actuation device 21*b* can be introduced into long bore 16 to rest upon retainer 20*b* within another down-hole actuation retaining space 23*b*. This operation is repeated, with each retainer being driven into a blocking position and a down-hole actuation device 21 being loaded onto each retainer 20 until the apparatus is fully loaded with all desired down-hole actuation devices 21. For any given down-hole assembly of tools, different numbers and sizes of down-hole actuation devices 21 may be required. As such, not all retainers may be employed each time the apparatus is used. In some down-hole assemblies it may be necessary to use a number of balls all with different diameters. To facilitate handling, the size of each down-hole actuation device 21 may determine which retainer is to be utilized. For example, as noted previously the space between the retainers 20 and ports 18 may vary and the control panel 34*b* may be demarked to identify the specific retainer 20 and possibly the size of the down-hole actuation device 21 that may rest upon each retainer 20.

Once all desired down-hole actuation devices 21 are loaded into the apparatus and resting in long bore 16 each upon an individual retainer 20, top end 14 may be sealed by various ways such as standard oil field practices and equipment to ensure the containment of pressure and fluids within long bore 16 and the apparatus can be connected to a well head at bottom end 12. For example by way of the flanged and sealed connection.

One embodiment the apparatus may be employed with a pumping block 40 that connects between bottom end 12 and the well head 15. At least one well fluid delivery line 41 may be connected to pumping block 40 to continuously introduce fluid into the well.

To launch down-hole actuation devices, the devices closest to well head 15 must be released first, followed by the next closest device etc. In the illustrated embodiment, retainer 20*a* that is most proximal to bottom end 12 is first retracted to a release position by first actuation of its associated cylinder 24. This will cause down-hole actuating device 20*a* that was resting upon said retainer 20*a* to fall into the well head 15 and, for example, into the fluid being introduced into well head 15 through pumping block 40, via line 41. Once down-hole actuation device 21*a* has been launched into the well bore and completed its desired operation therein, the operator may use control panel 34*b* to drive cylinder 24*b* into a release position so that retainer 22*b* is moved into a release position and down-hole actuation device 21*b* is launched through the well head into the well bore. This process may continue releasing down-hole actuation devices 21 into the well bore sequentially moving up long bore 16 from bottom end 12 to top end 14 until all down-hole actuation devices 21 of interest have been launched into the well bore.

The down-hole actuation devices 21 may be launched by gravity. However, if desired, a fluid conduit 42 may be connected to top end 14 to provide fluid flow down through long bore 16 to act as a pushing force for the launching of down-hole actuation devices 21. Conduit 42 may be connected between lines 41 and long bore 16. Fluid conduit 42 may include valve 44. When a down-hole actuating device 21 is not being launched, valve 44 may be closed, preventing flow through line 42 to bore 16. When launching a down-hole actuating device 21, valve 44 may be opened to permit the flow of fluid through fluid conduit 42 and into long bore 16 from top end 14. Valve 44 may be manually or remotely operated by way of hydraulic, pneumatic or robotic controls. The flow of fluids through line 42 into long bore 16 from top end 14 may provide force, in addition to gravity, to assist in pushing down-hole actuation device 21 through long bore 16 into the well head.

In one embodiment, the apparatus may contain various holding tanks, reservoirs or holding spools that hold and conduct fluid from source 34*a* to line 36 and line 38. For example, fluid from source 34*a* can be held in holding spool 50*a* before the fluid travels along lines 36*a* to drive the position of piston 22*a* and move retainer 20*a* into a release position. Further, when moving retainer 20*a* to a blocking position, fluid from holding spool 50*a* could travel along line 38*a* to drive cylinder 24*a* towards body 10 and move retainer 20*a* into a blocking position. There is a holding spool 50 associated with each hydraulic cylinder 24.

Additionally, in an embodiment, control panel 34*b* may include a number of levers that control the flow of fluid from source 34*a* to the holding spools 50. In operation, the operator may first actuate lever 48*a* to select holding spool 50*a*. Next the operator may actuate a lever 46 to permit fluid to flow from source 34*a* to holding spool 50*a*. To move the position of retainer 20*a* the operator may actuate lever 48*a* to permit fluid to move along line 36*a* and drive cylinder 24*a* to move retainer 20*a* to move into a release position. As one can appreciate various embodiments may also include lever 52*a* which when actuated would permit the flow of fluids from holding spool 50*a* along line 38*a* to cause the extension of retainer 20*a* into a blocking position within long bore 16.

When the apparatus has been loaded with all down-hole actuation devices 21 of interest, to launch down-hole actuation device 21*a*, the operator may actuate lever 48*a* to select loading spool 50*a* and lever 46 to load fluid from source 34*a* through line 36*a* of interest to drive cylinder 24*a* to move the position of retainer 20*a* to a release position. As described above, this will cause down-hole actuation device 20*a* to fall through long bore 16 into the well head and ultimately the well bore. The operator may open valve 44 to provide further pushing force upon down-hole actuation device 21*a* to assist in launching down-hole actuation device 21*a* into the well-bore. Upon completion of the launch, the operator may actuate lever 48*a* to stop the flow of fluid along line 36*a* and lever 46 to close the flow of fluid from source 34*a* to holding spool 50*a*.

After down-hole actuation device 21*a* completes its actuation of a down-hole assembly of tools, the operator may next actuate lever 48*b* to select holding spool 50*b*. Then the operator may actuate lever 46 to load fluid from source 34*a* into holding spool 50*b*. To launch down-hole actuation device 21*b* the operator may actuate lever 48*b* to permit the flow of fluid through line 38*b* to drive cylinder 24*b* to move the position of retainer 20*b* to a release position and down-hole actuation device 21*b* will launch into the well bore. The operator may open valve 44 to provide further pushing force upon down-hole actuation device 21*b* to assist in launching down-hole actuation device 21*b* into the well-bore. Upon completion of the launch, the operator may actuate lever 48*b* to stop the flow of fluid along line 38*a* and lever 46 to close the flow of fluid from source 34*a* to holding spool 50*b*. As one can appreciate this sequence can be repeated until all down-hole actuation devices 21 of interest are launched into the well-bore.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are know or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

I claim:

1. An apparatus for holding and launching down-hole actuation devices into a well, comprising:

(a) a body with a bottom end, a top end and a long bore that extends from the bottom end to the top end, the bottom end formed for connection above a well head to place the long bore in fluid communication with the well head;

(b) a first retainer and a second retainer each of the first and the second retainer being extendable into a blocking position in the long bore, and retractable from the blocking position in the long bore, the first and second retainers being spaced apart along the long bore defining there between a first down-hole actuation device retaining space and a second down-hole actuation device retaining space between the second retainer and the top end, the first retainer being moveable into and out of its blocking position independently of the second retainer to hold or allow release of a down-hole actuation device from the long bore;

(c) a removable cap on the top end engageable in a sealing position to fluidly seal the long bore from the apparatus outer surface but permitting access to the long bore from the outer surface when removed and a fluid inlet opening to the long bore adjacent the top end to provide an access for a flow of the fluid to the long bore when the cap is in the sealing position; and, (d) a hydraulic drive mechanism for driving extension of the first retainer into the long bore to a blocking position and for driving retraction of the first retainer out of the long bore to a release position, the hydraulic drive mechanism including (i) a cylinder for driving the first retainer, the cylinder including a hydraulic fluid inlet for communicating hydraulic fluid to a retraction drive side of the cylinder and a hydraulic fluid outlet for allowing evacuation of fluid from the cylinder during retraction, (ii) a valve on the hydraulic fluid outlet and (iii) a lock that permits retraction of the first retainer only when communication of a hydraulic drive pressure to the hydraulic drive mechanism is sensed, the lock including a sensor to monitor hydraulic pressure in the hydraulic fluid inlet and a communicator between the sensor and the valve that opens the valve when the sensor senses a hydraulic drive pressure in the hydraulic fluid inlet.

2. The apparatus as defined in claim 1, wherein the lock resists retraction movement of the first retainer in response to a pressure fluctuation in the long bore.

3. The apparatus as defined in claim 1, wherein the first down-hole actuation device retaining space has a first length measured along a long axis of the long bore and the second down-hole actuation device retaining space has a second length measured along the long axis of the long bore and the first length is shorter than the second length.

4. The apparatus as defined in claim 1, wherein the second retainer is sized relative to the long bore to permit fluid flow therepast when in the blocking position.

5. The apparatus as defined in claim 1 wherein the fluid inlet passes through the cap.

6. The apparatus as defined in claim 1 further comprising a valve to control flow through the fluid inlet.

7. A method for launching down-hole actuation devices, the method comprising:

(a) providing an apparatus for holding down-hole actuation devices including:

(i) a body with a bottom end, a top end and a long bore that extends from the bottom end to the top end, bottom end formed for connection above a well head to place the long bore in fluid communication with the well head;

a first retainer and a second retainer each of the first and the second retainer being extendable into a blocking position in the long bore, and retractable from the blocking position in the long bore, the first and second retainers being spaced apart along the long bore defining there between a first down-hole actuation device retaining space and a second down-hole actuation device retaining space between the second retainer and to the top end, the first retainer being moveable into a blocking position and a release position independently of the second retainer to hold or allow release of a down-hole actuation device from the long bore;

a hydraulic drive mechanism including a hydraulic cylinder for driving retraction of the first retainer out from the long bore to a release position;

(b) with the first retainer in its blocking position, loading a first down-hole actuation device into the long bore to rest upon the first retainer and within the first down-hole actuation device retaining space;

(c) moving the second retainer into a blocking position;

(d) loading a second down-hole actuation device into the long bore to rest upon the second retainer and within the second down-hole actuation device retaining space;

(e) connecting the apparatus at the bottom end to the well head;

(f) preventing any fluid evacuation from the hydraulic cylinder to prevent any movement of the first retainer toward the release position unless a hydraulic drive pressure is sensed being communicated to the hydraulic drive mechanism and when hydraulic drive pressure is sensed, permitting fluid evacuation from the hydraulic cylinder to allow the first retainer to be moved into a release position allowing the first down-hole actuation device to launch into the well head; and (g) communicating a fluid flow to the long bore from adjacent the top end to flow past the second down-hole actuating device and to urge the first down-hole actuation device from the long bore.

8. The method as in claim 7, further comprising locking the second retainer into the blocking position resisting any movement of the second retainer toward the release position unless a hydraulic drive pressure for the second retainer is sensed.

9. The method as in claim 7, wherein the hydraulic drive mechanism includes a valve that controls fluid evacuation from the hydraulic cylinder and permitting includes opening the valve.

10. The method as in claim 8, wherein locking includes closing a valve to prevent hydraulic fluid evacuation from a hydraulic cylinder for the second retainer.

* * * * *